US010961606B2

(12) United States Patent
Zhu et al.

(10) Patent No.: US 10,961,606 B2
(45) Date of Patent: Mar. 30, 2021

(54) PREPARATION METHOD OF A WC CEMENTED CARBIDE WITH ADJUSTABLE ALIGNMENT OF PLATE-SHAPE GRAINS

(71) Applicant: SOUTH CHINA UNIVERSITY OF TECHNOLOGY, Guangzhou (CN)

(72) Inventors: Min Zhu, Guangzhou (CN); Wei Wang, Guangzhou (CN); Zhongchen Lu, Guangzhou (CN); Meiqin Zeng, Guangzhou (CN); Xianyong Bao, Guangzhou (CN)

(73) Assignee: SOUTH CHINA UNIVERSITY OF TECHNOLOGY, Guangzhou (CN)

( * ) Notice: Subject to any disclaimer, the term of this patent is extended or adjusted under 35 U.S.C. 154(b) by 176 days.

(21) Appl. No.: 16/343,766

(22) PCT Filed: Dec. 21, 2017

(86) PCT No.: PCT/CN2017/117674
§ 371 (c)(1),
(2) Date: Apr. 21, 2019

(87) PCT Pub. No.: WO2018/099491
PCT Pub. Date: Jun. 7, 2018

(65) Prior Publication Data

US 2020/0056266 A1 Feb. 20, 2020

(30) Foreign Application Priority Data

Nov. 29, 2016 (CN) ..... 201611070625.0

(51) Int. Cl.
*C22C 29/06* (2006.01)
*C22C 29/08* (2006.01)
(Continued)

(52) U.S. Cl.
CPC ..... *C22C 1/055* (2013.01); *C22C 29/067* (2013.01); *C22C 29/08* (2013.01); *B22F 3/16* (2013.01)

(58) Field of Classification Search
CPC .. B22F 1/0014; B22F 3/12; B22F 3/14; B22F 3/15; B22F 3/156; B22F 3/16;
(Continued)

(56) References Cited

U.S. PATENT DOCUMENTS

2017/0348699 A1* 12/2017 Zhu ..... B02C 19/18

FOREIGN PATENT DOCUMENTS

CN 1803347 7/2006
CN 101181752 5/2008
(Continued)

*Primary Examiner* — Vanessa T. Luk
(74) *Attorney, Agent, or Firm* — JMB Davis Ben-David

(57) ABSTRACT

The invention discloses a preparation method of a WC cemented carbide with adjustable alignment of plate-shape grains. According to the theoretical composition of the cemented carbide, the weighed W powder is composed of two raw W materials with significantly different particle sizes in a certain mass ratio. Also graphite powder and Co powder are weighed. W—C—Co powder is subjected to planetary ball milling with controlled process parameters; then, after plasma-assisted ball milling, W—C—Co composite powder composed of small-sized lamellar W sheets and large-sized lamellar W sheet is obtained; Finally dense cemented carbide containing plate-shape WC grains is obtained by press molding of the ball milled power and in-situ carbonization through sintering at a high temperature. The invention not only provides simple preparation process with low energy consumption, but also can regulate the degree of orientated alignment of the plate-shape WC in the sintered block. Besides, the mechanical properties of the WC—Co cemented carbide containing plate-shape WC
(Continued)

grains are optimized, so that the cemented carbide has excellent overall mechanical properties.

7 Claims, 9 Drawing Sheets

(51) Int. Cl.
*B22F 3/16* (2006.01)
*C22C 1/05* (2006.01)

(58) Field of Classification Search
CPC ..... B22F 3/162; B22F 3/164; B22F 3/168; B22F 2003/145; B22F 2003/153; B22F 2003/166; B22F 2005/001; B22F 2301/15; B22F 2302/10; B22F 2302/40; C22C 1/0433; C22C 1/051; C22C 1/055; C22C 1/10; C22C 1/1005; C22C 1/1015; C22C 1/1068; C22C 1/1084; C22C 29/005; C22C 29/02; C22C 29/06; C22C 29/067; C22C 29/08
See application file for complete search history.

(56) References Cited

FOREIGN PATENT DOCUMENTS

| | | | | |
|---|---|---|---|---|
| CN | 101181752 A * | 5/2008 | | |
| CN | 106702247 | 5/2017 | | |
| JP | 2001073012 | 3/2001 | | |
| WO | WO-2016101187 A1 * | 6/2016 | ..... | B22F 9/14 |

* cited by examiner

PREPARATION METHOD OF A WC CEMENTED CARBIDE WITH ADJUSTABLE ALIGNMENT OF PLATE-SHAPE GRAINS

CROSS-REFERENCE TO RELATED APPLICATIONS

This is the U.S. National Stage of International Patent Application No. PCT/CN2017/117674 filed Dec. 21, 2017, which was published in Chinese under PCT Article 21(2), and which in turn claims the benefit of Chinese Patent Application No. 201611070625.0 filed Nov. 29, 2016.

TECHNICAL FIELD

The invention relates to the preparation of a WC—Co cemented carbide, in particular to a preparation method of a WC cemented carbide with adjustable alignment of plate-shape grains

BACKGROUND ART

As a hard material with high hardness and excellent wear resistance, WC—Co cemented carbide is widely used in the fields of machining and mining, and is known as "industrial teeth". However, traditional WC—Co cemented carbide is a cermet material, whose hardness and strength, that is, wear resistance and toughness (crack resistance) are two contradictory characteristics. When the hardness is increased, the toughness of the material is usually sacrificed, and vice versa, which limits the further development of cemented carbides. Therefore, development of cemented carbides with high hardness, high strength, high toughness and with other good mechanical properties has become the focus of cemented caride research. Based this situation, many preparation methods for nano/ultrafine crystal WC, twin crystal structure WC, cobalt gradient functional cemented carbide and the like with good hardness, strength and toughness have been well developed.

The WC crystal has a close-packed hexagonal structure. As a hexagonal anisotropic crystal, the hardness of the (0001) crystal plane is higher than that of other crystal planes. However, the WC grains in the conventional WC—Co cemented carbide are mostly triangular or polygonal prism-like bodies. If the (0001) plane of the triangular or polygonal prism-like bodies is preferentially grown, it can be transformed into plate-shape WC grains. And as the proportion of the (0001) plane increases, the overall hardness and toughness of the cemented carbide are improved. Therefore, cemented carbide containing plate-shape WC grains has better comprehensive mechanical properties than conventional cemented carbides, and has unique advantages in practical applications. It is a new development direction in the field of cemented carbides.

At present, the raw materials used for preparing the plate-shape WC generally includes the following three types: elemental W powder, WC powder and $W_xCo_yC$ powder. The common feature of these methods is that in the preliminary stage of preparing the plate-shape WC, precursors that can be transformed to plate-shape WC during the subsequent sintering process (specially treated W, WC, $W_xCo_yC$, etc.) are preferentially prepared.

A research indicates that micron-sized W powder with special treatment is used, and W is converted into a plate-shape body to prepare a cemented carbide containing plate-shape WC grains. However, a disadvantage of this type of method is that the content of the plate-shape W is low, and it is necessary to increase the sintering temperature and prolong the sintering time to obtain plate-shape WC. For this method, the yield of the plate-shape WC is low, it is difficult to achieve regulate the proportion of the plate-shape WC, and the preparation is time consuming with complicated process and high energy consumption.

Preparation methods of a cemented carbide containing (bulk) plate-shape WC grains is disclosed in Chinese patent CN101117673A and CN101376931A. In these methods, high-energy ball milling is used to prepare a mixture of plate-shape WC seed crystals and Co, and subsequently a mixed crystal structure composed of plate-shape WC and conventional WC grains is obtained by hot-pressing and sintering. However, since the length of plate-shape structure is usually 3-8 μm, the size of the plate-shape WC crystal grains is so large that it is disadvantageous for strengthening of the cemented carbide. And the (0001) plane of the plate-shape WC is preferable to grow perpendicularly to the pressing force, resulting in anisotropy of the mechanical properties of the cemented carbide.

Chinese patent CN1068067C discloses "cemented carbide containing plate-shape crystalline WC and the preparation method thereof", which adopts a two-step process, that is, first prepares plate-shape crystalline WC powder containing $Co_3W_3C$, $Co_6W_6C$, etc., and then the powder is used with carbon source to prepare a cemented carbide containing plate-shape crystalline WC. However, this method has poor process stability.

Although the above method can well prepare the plate-shape WC, the processes are complicated with long production cycle and high energy consumption. Also, the alignment and orientation of the plate-shape WC in the cemented carbide are not well regulated. The relationship between the alignment of the plate-shape WC grains and the mechanical properties of the cemented carbide usually has the two following possibilities: (1) When the plate-shape WC is disorderly aligned in the cemented carbide, the mechanical properties of the cemented carbide have good uniformity, but they are still poor relative to oriented alignment; (2) When the plate-shape WC is highly oriented, although the cemented carbide has excellent properties in the part with more WC (0001) crystal planes, the performance of other parts is relatively poor due to anisotropy of WC, which is not conducive to the mechanical properties of the cemented carbide in actual working conditions. It can be seen that it is important to seek a preparation method of plate-shape WC cemented carbide with low energy consumption, short production cycle, available to prepare high-content plate-shape WC grains, and control the orientation of the alignment of the plate-shape WC grains while ensuring good hardness and uniform mechanical properties of the cemented carbide.

SUMMARY OF THE INVENTION

In order to overcome the above disadvantages of the prior art, an object of the present invention is to provide a preparation method of a WC cemented carbide with adjustable alignment of plate-shape grains, which optimizes the mechanical properties of WC—Co cemented carbide with plate-shape WC grains so that excellent mechanical properties thereof can be achieved. And the method is simple with low energy consumption.

The object of the invention is achieved by the following technical solutions:

A preparation method of a WC cemented carbide with adjustable alignment of plate-shape grains, comprising the steps of:

(1) weighting graphite powder, Co powder and W powder according to the composition of WC—XCo; characterized in that, the W powder comprises fine W particles and coarse W particles, and 6≤X≤20; the fine W particles has a particle size of 0.3 μm-1 μm; the coarse W particles has a particle size of 5 μm-25 μm;

the mass ratio of the fine W particles to the coarse W particles is 1:4-4:1;

(2) adding the graphite powder, the Co powder and the W powder in step (1), and required extra amount of carbon in a planetary ball mill for planetary ball milling to obtain W—C—Co powder;

(3) placing the W—C—Co powder obtained in step (2) in a plasma-assisted high-energy ball mill for plasma-assisted ball milling to obtain W—C—Co composite powder;

(4) subjecting the W—C—Co composite powder obtained in step (3) to uniaxial compression molding to obtain W—C—Co powder green body;

(5) carbonizing the W—C—Co powder green body by sintering at 1350-1550° C.

The graphite powder in step (1) has a particle size of 20 μm-80 μm.

The particle size of the Co powder in step (1) is 0.5 μm-5 μm.

The specific parameters of the planetary ball milling in step (2) are: a ball-to-batch ratio of 1:3-1:5, and a ball milling time of 5-10 h.

The specific parameters of the plasma-assisted ball milling in step (3) are: a ball-to-batch ratio of 30:1-60:1, a ball milling time of 3~6 h, and a discharge current of 1-3 A.

The WC—Co composite powder in step (3) is composed of a raw small-sized lamellar W sheet and a raw large-sized lamellar W sheet, wherein the raw small-sized lamellar W sheet has a length of 200 nm-1.5 μm and a thickness of 40 nm-200 nm, and the raw large-sized lamellar W sheet has a length of 3 μm-15 μm and a thickness of 60 nm-300 nm.

Said carbonizing by sintering refers to vacuum sintering or low pressure sintering.

Compared with the prior art, the present invention has the following advantages:

(1) The invention adopts a two-step method of planetary low energy pre-ball milling followed by plasma-assisted ball milling to prepare cemented carbide powder. The planetary low energy pre-ball milling is beneficial to preparation of W—C—Co which has uniform distribution and low strength combination among the particles and can avoid the segregation of powder in the subsequent plasma-assisted ball milling; in the plasma-assisted ball milling process, W can be flattened in a short time (3~6 h) to obtain W—C—Co composite powder with lamellar W sheet.

(2) The amount of the small-sized lamellar W sheet and the large-sized lamellar W sheet in the ball milled W—C—Co powder can be adjusted by adjusting the mass ratio of the raw small-sized W to the raw large-sized W, which further realizes the regulation of the orientation of the plate-shape WC in the prepared cemented carbide, and optimizes the mechanical properties of the cemented carbide.

(3) Compared with other preparation methods of plate-shape WC, the W—C—Co powder obtained by plasma-assisted ball milling for 3-6 hours can be directly carbonized and sintered under high temperature to obtain high content plate-shape WC which accounts for 65% of grains in the cemented carbide.

(4) The preparation method of the invention is fast and easy to operate with main steps of "pre-ball milling, plasma-assisted ball milling, powder compression and molding, and in-situ high-temperature carbonization by sintering". It overcomes the disadvantages of traditional preparation methods of high-content plate-shape WC cemented carbide, which are long production cycle, complicated procedures, and high energy consumption.

DETAILED DESCRIPTION OF THE EMBODIMENTS

The present invention will be further described in detail below with reference to the embodiments, but the embodiments of the present invention are not limited thereto.

Example 1

Figure 1:
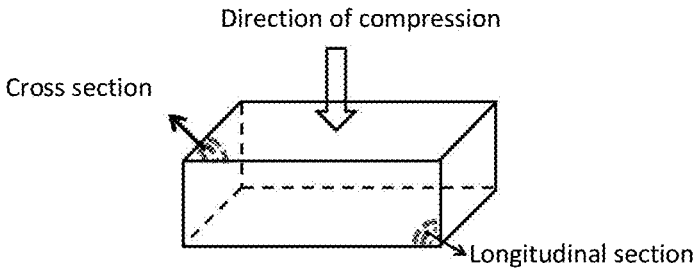
FIG. 1 is a schematic diagram of the definition and test of different sections of cemented carbide.

As shown in FIG. 1, the preparation method of a WC cemented carbide with adjustable alignment of plate-shape grains comprises the following steps:

(1) Taking WC-8 wt. % Co as a final component, selecting raw W having a particle size of 0.5 μm and raw W having a particle size of 12 μm as sources of W powder. According to the theoretical composition of the cemented carbide, the composition of the W powder consists of W having a particle size of 0.5 μm and W having a particle size of 12 μm in a mass ratio of 1:1. Weighting graphite powder with a size of 30 μm, Co powder with a size of 5 μm, and additional carbon which is 5.8% of the theoretical carbon content in the cemented carbide.

(2) Placing the above W powder, graphite powder and Co powder in a planetary ball mill to conduct low-energy pre-ball milling for 5 h, wherein the speed of the ball milling is 200 r/min, and the ball-to-batch ratio is 1:5 to achieve homogeneous distribution of the powder and low strength combination among the particles to obtain a pre-milled WC—Co powder.

(3) Placing the pre-ball-milled WC—Co powder in a plasma-assisted ball mill to conduct plasma-assisted ball milling for 3 h with a ball-to-batch ratio of 50:1, a ball-milling speed of 960 r/min, and a discharge current of 1.5 A. W—C—Co composite powder containing small-sized lamellar W sheet and large-sized lamellar W-sheet was obtained.

(4) Placing the W—C—Co composite powder containing lamellar W sheets with two sizes obtained in step (3) in a mold, pressing by uni-axial compression molding with a pressing pressure of 220 MPa and a pressing time of 3 min, then demolding to obtain a powder green body.

(5) Sintering the green body by a low pressure sintering process. The low-pressure sintering process is as follows: after vacuuming to 1 Pa, raising the temperature to 1390° C. at a heating rate of 10 K/min; after reaching the highest temperature, charging Ar gas at 4 MPa, keeping the temperature for 60 min, and then cooling to room temperature at a cooling rate of 20 K/min to obtain WC—Co cemented carbide having plate-shape WC grains, which was designated as sample F1P1.

Raw W with particle size of 0.5 μm and raw W with particle size of 12 μm were pre-ball milled and plasma-assisted ball-milled with graphite powder and Co powder, respectively, to obtain single-scale WC—Co powders containing lamellar W sheets. Then pressing and sintering the powders, wherein the samples obtained were designated as sample F and sample P, respectively, and used as a comparative sample.

SEM and XRD were used to observe and characterize the powder morphology of sample F and sample P, the three-dimensional morphology after carbonization by sintering and the topography as well as phase composition of different block sections of the plate-shape WC, which can be seen in FIG. 2 to FIG. 7 and FIG. 8 to FIG. 13 respectively; the topography and XRD of different cross sections of the sample F1P1 are shown in FIG. 14 to FIG. 17. The degree of oriented alignment of the plate-shape WC is mainly reflected in the ratio of the peak intensity of the WC (0001) crystal plane to the peak intensity of the $(10\bar{1}0)$ crystal plane in the XRD pattern, which is denoted as $I(0001)/I(10\bar{1}0)$, and is listed in Table 1. The mechanical properties were tested on different sections of the cemented carbide, and the test results are listed in Table 2.

Figure 2:
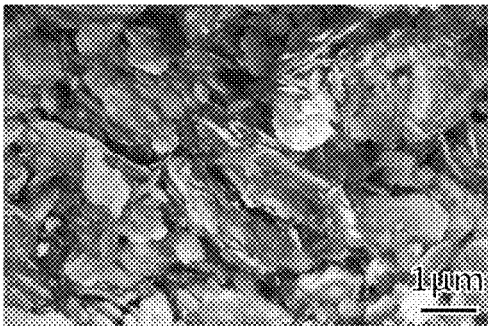
FIG. 2 is a topographical view of the F powder after ball milling in Example 1.
Figure 3:
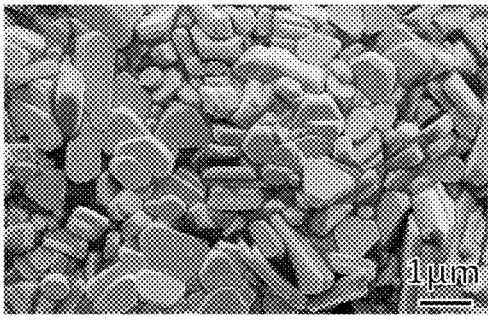
FIG. 3 is a three-dimensional topographical view of the plate-shape WC in the sample F in Example 1.
Figure 4:
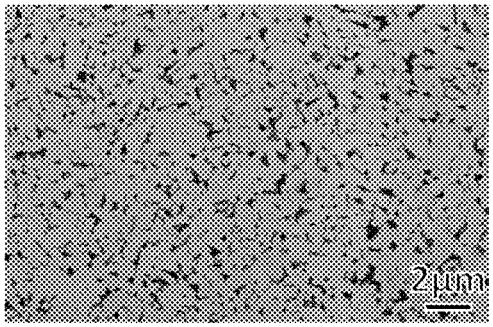
FIG. 4 is a SEM image showing the microstructure of the sample F in Example 1 along cross sectional direction.
Figure 5:
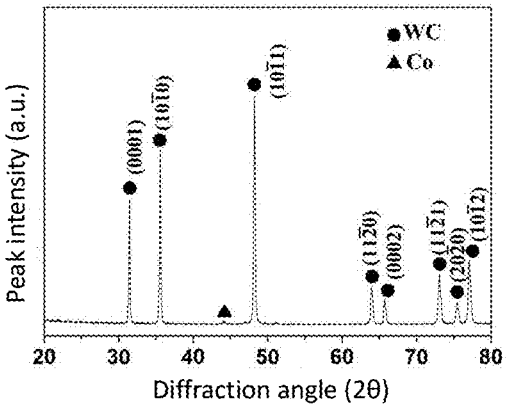
FIG. 5 is an X-ray diffraction pattern of the sample F in Example 1a long the cross sectional direction.
Figure 6:
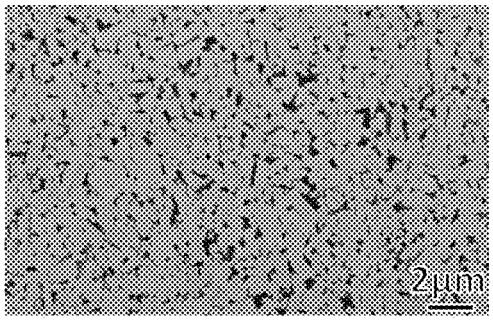
FIG. 6 is a SEM image showing the microstructure of the sample F in Example 1a long longitudinal sectional direction.
Figure 7:
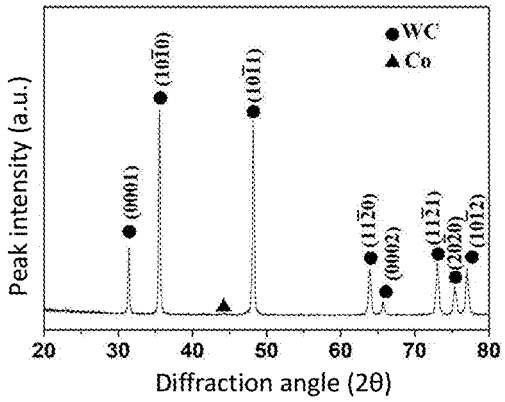
FIG. 7 is an X-ray diffraction pattern of the sample F in Example 1a long the longitudinal sectional direction.

In FIG. 2, it can be seen that W—C—Co composite powder obtained from 0.5 μm W powder has a distinct lamellar structure, the length of which is 0.3-1.0 um and the thickness of which is about 60-180 nm. FIG. 3 shows that the WC in the F sample has a distinct plate-shape characteristic, wherein the average grain size of the plate-shape WC is 552 nm, and the content of the plate-shape WC is 68.5%. FIGS. 4 and 6 show that the morphologies of plate-shape WC along cross sectional direction and along longitudinal sectional direction are similar, indicating that the plate-shape WC alignment is disordered, which is consistent with the XRD peak shape obtained in FIGS. 5 and 7; $I(0001)/I(10\bar{1}0)$ along the cross sectional direction and along the longitudinal sectional direction are shown in Table 1, which are 0.71 and 0.43, further indicating the chaos of the alignment of the plate-shape WC. It can be seen from Table 2 that the F sample has good mechanical uniformity: along the cross sectional direction, the hardness is about 92.3 HRA, TRS=2926 MPa, and the fracture toughness is 18.75 $MPa*m^{1/2}$; along the longitudinal sectional direction, the hardness is 92.2 HRA, TRS=2865 MPa, and the fracture toughness is 18.67 $MPa*m^{1/2}$.

Figure 8:
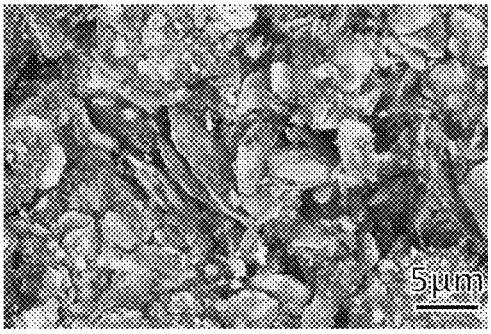
FIG. 8 is a topographical view of the P powder after ball milling in Example 1.
Figure 9:
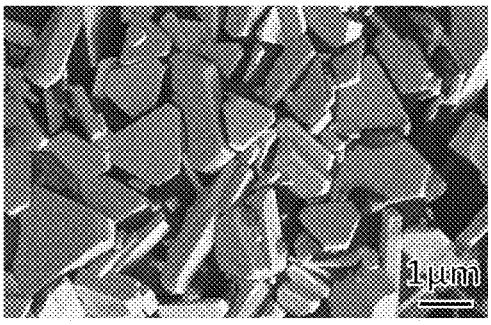
FIG. 9 is a three-dimensional topographical view of the plate-shape WC in the sample P in Example 1.
Figure 10:
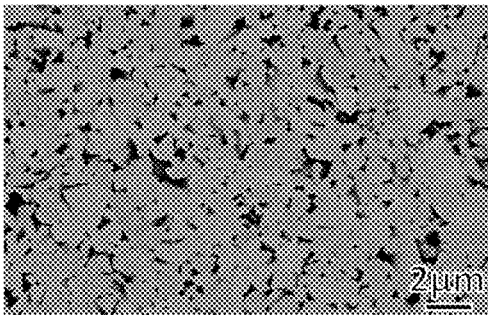
FIG. 10 is an SEM image of the microstructure of the sample P in Example 1 along the cross sectional direction.
Figure 11:
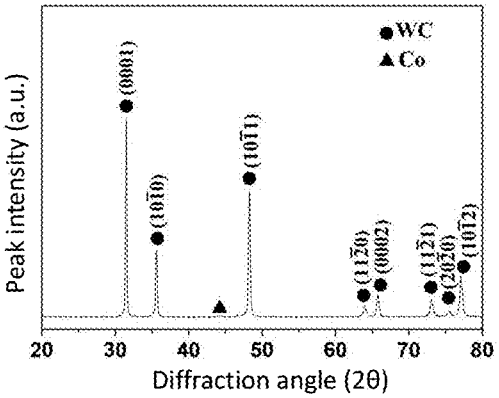
FIG. 11 is an X-ray diffraction pattern of the sample P in Example 1a long the cross sectional direction.
Figure 12:
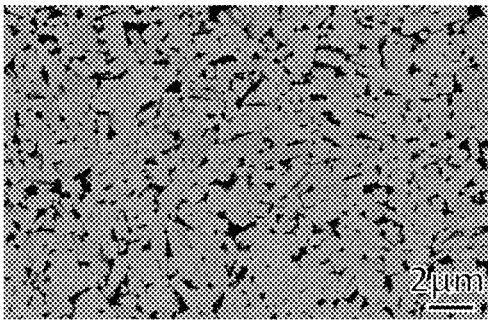
FIG. 12 is an SEM image showing the microstructure of the sample P in Example 1a long the longitudinal sectional direction.
Figure 13:
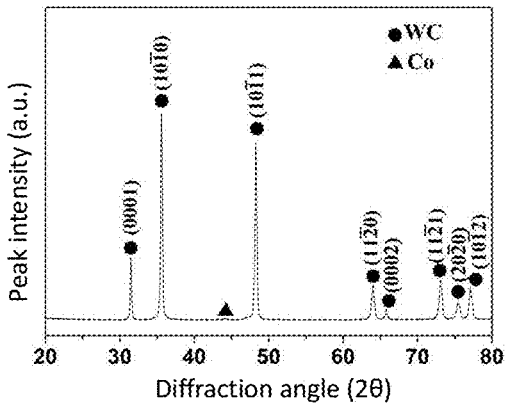
FIG. 13 is an X-ray diffraction pattern of the sample P in Example 1a long the longitudinal sectional direction.
Figure 14:
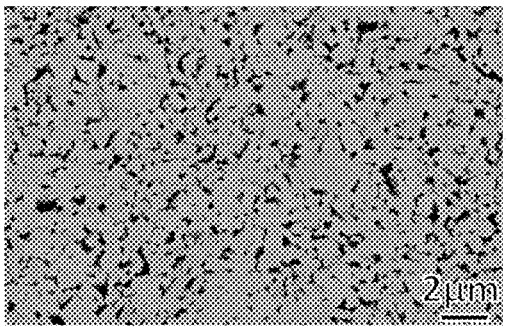
FIG. 14 is a SEM image of the microstructure of the sample F1P1 in Example 1a long the cross sectional direction.
Figure 15:
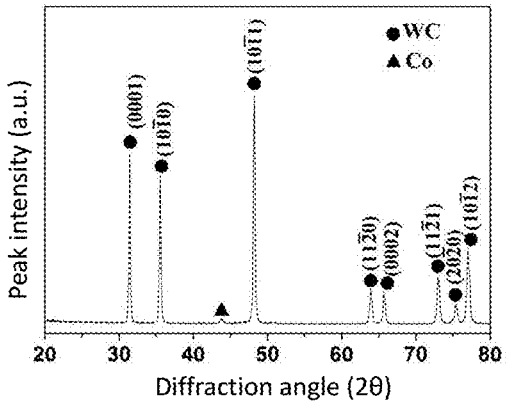
FIG. 15 is a cross-sectional X-ray diffraction pattern of the sample F1P1 in Example 1.
Figure 16:
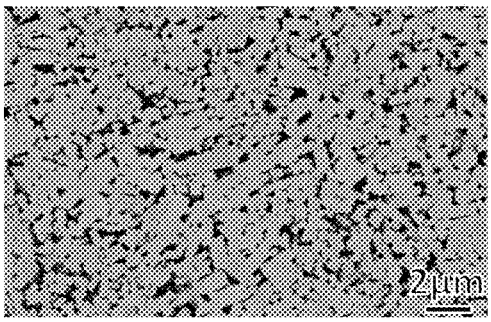
FIG. 16 is an SEM image showing the microstructure of the sample F1P1 in Example 1a long the longitudinal sectional direction.
Figure 17:
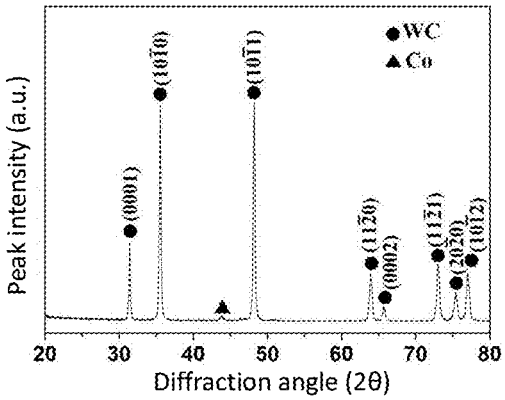
FIG. 17 is an X-ray diffraction pattern of the sample F1P1 in Example 1a long the longitudinal sectional direction.

In FIG. 8, it can be seen that in the W—C—Co composite powder obtained by using 12 μm W of the raw material as the W powder, most of the sheet W has a length of 3.0 to 10.0 μm and a thickness of 150 to 310 nm. FIG. 9 shows that the WC in the P sample also has a distinct plate-like characteristic. The average grain size of the plate-like WC is 1.21 μm, and the WC content of the plate is 72.2%. FIG. 10 shows that the WC shape along the cross sectional direction is a triangle. Or a truncated triangle, and FIG. 12 shows that the shape of the WC is mostly strip shape, and the different appearance of the WC along the cross sectional direction and the longitudinal section indicates that the WC has a highly directional arrangement. The peak shape of XRD in FIG. 11 and FIG. 13 and Table 1 show that the ratio of $I(0001)/I(10\bar{1}0)$ along the cross sectional direction and the longitudinal section is 2.85 and 0.27, indicating that the plate-like WC is in a highly aligned state. As can be seen from Table 2, the highly oriented arrangement of the plate-like WC in the P sample results in differences in the mechanical properties of the alloys on different cross sections: the hardness on the cross section is about 92.6 HRA, TRS=3389 MPa, and the fracture toughness is 19.52 $MPa*m^{1/2}$; the hardness on the longitudinal section is 92.1 HRA, TRS=2757 MPa, and the fracture toughness is 18.53 $MPa*m^{1/2}$.

For the F1P1 sample, the morphologies of the different sections are shown in FIGS. 14 to 17 and the degree of oriented alignment of the plate-shape WC is shown in Table 1: $I(0001)/I(10\bar{1}0)$ of the cross section and the longitudinal section are 1.31 and 0.35, respectively. Although the mechanical properties along cross sectional direction and longitudinal sectional direction are different, the overall mechanical properties are excellent: along the cross sectional direction, the hardness is about 92.3 HRA, TRS=3720 MPa, and the fracture toughness is 21.56 $MPa*m^{1/2}$; along the longitudinal sectional direction, the hardness is 92.2

HRA, TRS=3531 MPa, and the fracture toughness is 21.83 MPa*$m^{1/2}$. The content of the plate-shape WC in the cemented carbide was 70.4%.

Example 2

The steps of this example are basically the same as those of Example 1, except that the mass ratio of the raw Wwith a particle size of 0.5 μm and the raw W with a particle size of 12 μm are 4:1; the additional carbon content is 7.2% of the theoretical carbon content in the cemented carbide; and the WC-8Co cemented carbide with plate-shape WC grains prepared by the low-pressure sintering process is denoted as sample F4P1. The degree of oriented alignment of the plate-shape WC in the cemented carbide is listed in Table 1, and mechanical properties of different sections of the cemented carbide are shown in Table 2. The degree of oriented alignment of the plate-shaped WC in sample F4P1 is: the I(0001)/I(10 $\bar{1}$ 0) ratio of the cross-section and the longitudinal section are 0.86 and 0.37, respectively. Along the cross sectional direction, the hardness is about 92.2 HRA, TRS=3191 MPa, and the fracture toughness is 19.43 MPa*$M^{1/2}$; along the longitudinal sectional direction, the hardness is 92.2 HRA, TRS=3224 MPa, and the fracture toughness is 19.87 MPa*$M^{1/2}$. The content of plate-shape WC in the cemented carbide was 69.3%.

Example 3

The steps of this example are basically the same as those of Example 1, except that the mass ratio of the raw W with a particle size of 0.5 μm and the raw W with a particle size of 12 μm are 3:2; the additional carbon content is 6.2% of the theoretical carbon content in the cemented carbide; and the WC-8Co cemented carbide with plate-shape WC grains prepared by the low-pressure sintering process is denoted as sample F3P2. The degree of oriented alignment of the plate-shape WC in the cemented carbide is listed in Table 1, and mechanical properties of different sections of the cemented carbide are shown in Table 2. The degree of oriented alignment of the plate-shaped WC in sample F3P2 is: the I(0001)/I(10 $\bar{1}$ 0) ratio of the cross-section and the longitudinal section are 1.06 and 0.36, respectively. Along the cross sectional direction, the hardness is about 92.3 HRA, TRS=3428 MPa, and the fracture toughness is 20.12 MPa*$M^{1/2}$; along the longitudinal sectional direction, the hardness is 92.1 HRA, TRS=3398M Pa, and the fracture toughness is 20.04 MPa*$M^{1/2}$. The content of plate-shape WC in the cemented carbide was 70.2%.

Example 4

The steps of this example are basically the same as those of Example 1, except that the mass ratio of the raw W with a particle size of 0.5 μm and the raw W with a particle size of 12 μm are 2:3; the additional carbon content is 5.4% of the theoretical carbon content in the cemented carbide; and the WC-8Co cemented carbide with plate-shape WC grains prepared by the low-pressure sintering process is denoted as sample F2P3. The degree of oriented alignment of the plate-shape WC in the cemented carbide is listed in Table 1, and mechanical properties of different sections of the cemented carbide are shown in Table 2. The degree of oriented alignment of the plate-shaped WC in sample F2P3 is: the I(0001)/I(10 $\bar{1}$ 0) ratio of the cross-section and the longitudinal section are 1.77 and 0.33, respectively. Along the cross sectional direction, the hardness is about 92.4 HRA, TRS=3826 MPa, and the fracture toughness is 21.60 MPa*$M^{1/2}$; along the longitudinal sectional direction, the hardness is 92.2 HRA, TRS=3117 MPa, and the fracture toughness is 20.48 MPa*$M^{1/2}$. The content of plate-shape WC in the cemented carbide was 70.7%.

Example 5

The steps of this example are basically the same as those of Example 1, except that the mass ratio of the raw W with a particle size of 0.5 μm and the raw W with a particle size of 12 μm are 1:4; the additional carbon content is 4.5% of the theoretical carbon content in the cemented carbide; and the WC-8Co cemented carbide with plate-shape WC grains prepared by the low-pressure sintering process is denoted as sample F1P4. The degree of oriented alignment of the plate-shape WC in the cemented carbide is listed in Table 1, and mechanical properties of different sections of the cemented carbide are shown in Table 2. The degree of oriented alignment of the plate-shaped WC in sample F1P4 is: the I(0001)/I(10 $\bar{1}$ 0) ratio of the cross-section and the longitudinal section are 1.96 and 0.31, respectively. Along the cross sectional direction, the hardness is about 92.6 HRA, TRS=3562 MPa, and the fracture toughness is 20.13 MPa*$M^{1/2}$; along the longitudinal sectional direction, the hardness is 92.1 HRA, TRS=2964 MPa, and the fracture toughness is 19.62 MPa*$M^{1/2}$. The content of plate-shape WC in the cemented carbide was 71.5%.

From the results of Example 1 to Example 5 (see Tables 1 and 2), it is understood that by controlling the mass ratio of W—C—Co composite powder containing small-sized lamellar W sheets and W—C—Co composite powder containing large-sized lamellar W sheets, the alignment of the plate-shape WC in the prepared cemented carbide can be adjusted, thereby optimizing the overall mechanical properties of the cemented carbide.

TABLE 1

Degree of oriented alignment of plate-shape WC in WC-8Co cemented carbide containing plate-shape WC grains

| Sample | Cross section Ratio of peak intensity I(0001)/I(10$\bar{1}$0) | Longitudinal section Ratio of peak intensity I(0001)/I(10$\bar{1}$0) |
|---|---|---|
| Comparative sample 1 in Example 1 (F) | 0.71 | 0.43 |
| F4P1 sample in Example 2 | 0.86 | 0.37 |
| F3P2sample in Example 3 | 1.06 | 0.36 |
| F1P1 sample in Example 1 | 1.31 | 0.35 |
| F2P3sample in Example 4 | 1.77 | 0.33 |
| F1P4sample in Example 5 | 1.96 | 0.31 |
| Comparative sample 2 in Example 1 (P) | 2.85 | 0.27 |

TABLE 2

Physical and mechanical properties of WC-8Co cemented carbide with plate-shape WC grains

| Sample | Stacking ratio | Cross section hardness/ HRA | Cross section TRS/ MPa | Cross section Fractural strength MPa*m$^{1/2}$ | Longitudinal section hardness/ HRA | Longitudinal section TRS/ MPa | Longitudinal section Fractural strength MPa*m$^{1/2}$ |
|---|---|---|---|---|---|---|---|
| Comparative sample 1 in Example 1 (F) | 99.5% | 92.3 | 2926 | 18.75 | 92.2 | 2865 | 18.67 |
| F4P1 sample in Example 2 | 99.6% | 92.2 | 3191 | 19.43 | 92.2 | 3224 | 19.87 |
| F3P2 sample in Example 3 | 99.6% | 92.3 | 3428 | 20.12 | 92.1 | 3398 | 20.04 |
| F1P1 sample in Example 1 | 99.7% | 92.3 | 3720 | 21.56 | 92.2 | 3531 | 21.83 |
| F2P3 sample in Example 4 | 99.5% | 92.4 | 3826 | 21.60 | 92.2 | 3117 | 20.48 |
| F1P4 sample in Example 5 | 99.6% | 92.6 | 3562 | 20.13 | 92.1 | 2964 | 19.62 |
| Comparative sample 2 in Example 1 (P) | 99.7% | 92.6 | 3389 | 19.52 | 92.1 | 2757 | 18.53 |

Example 6

(1) Taking WC-6 wt. % Co as a final component, selecting raw W having a particle size of 0.3 μm and raw W having a particle size of 5 μm as sources of W powder. According to the theoretical composition of the cemented carbide, the composition of the W powder consists of W having a particle size of 0.3 μm and W having a particle size of 5 μm in a mass ratio of 3:2. Weighting graphite powder with a size of 20 μm, Co powder with a size of 5 μm, and additional carbon which is 8.0% of the theoretical carbon content in the cemented carbide.

(2) Placing the above W powder, graphite powder and Co powder in a planetary ball mill to conduct low-energy pre-ball milling for 8 h, wherein the speed of the ball milling is 150 r/min, and the ball-to-batch ratio is 1:4 to achieve homogeneous distribution of the powder and low strength combination among the particles to obtain a pre-milled WC—Co powder.

(3) Placing the pre-ball-milled WC—Co powder in a plasma-assisted ball mill to conduct plasma-assisted ball milling for 4.5 h with a ball-to-batch ratio of 40:1, a ball-milling speed of 1100 r/min, and a discharge current of 2.5 A. W—C—Co composite powder containing small-sized lamellar W sheet and large-sized lamellar W sheet was obtained, wherein the small-sized lamellar W sheet has a length of 0.3-0.6 μm and a thickness of 50-120 nm, and the large-sized lamellar W sheet has a length of 0.8-4.5 μm and a thickness of 120-240 nm.

(4) Placing the W—C—Co composite powder containing lamellar W sheets with two sizes obtained in step (3) in a mold, pressing by uni-axial compression molding with a pressing pressure of 150 MPa and a pressing time of 4 min, then demolding to obtain a powder green body.

Figure 18:
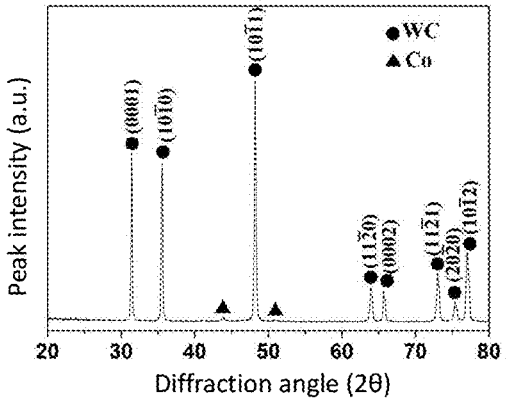
FIG. 18 is an X-ray diffraction pattern of sample T3G2 which is a cemented carbide block in Example 6 along the cross sectional direction.
Figure 19:
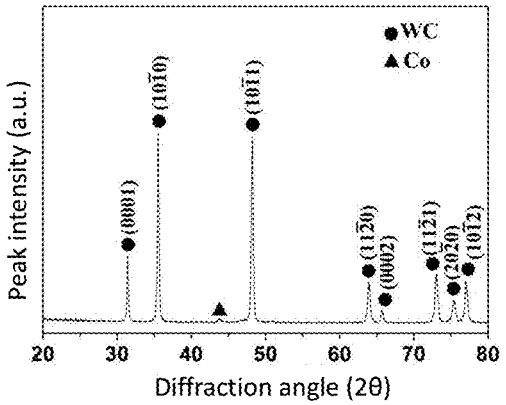
FIG. 19 is an X-ray diffraction pattern of a sample T3G2 which is a cemented carbide block in Example 6 along the longitudinal sectional direction.

(5) Sintering the green body by a low pressure sintering process. The low-pressure sintering process is as follows: after vacuuming to 1 Pa, raising the temperature to 1430° C. at a heating rate of 10 K/min; after reaching the highest temperature, charging Ar gas at 5 MPa, keeping the temperature for 45 min, and then cooling to room temperature at a cooling rate of 20 K/min to obtain WC-6Co cemented carbide having plate-shape WC grains, which was designated as sample T3G2. The I(0001)/I(10 $\bar{1}$ 0) ratio of the cross-section and the longitudinal section are 1.04 and 0.37, respectively. Along the cross sectional direction, the hardness is about 92.4 HRA, TRS=3282 MPa, and the fracture toughness is 18.32 MPa*M$^{1/2}$; along the longitudinal sectional direction, the hardness is 92.3 HRA, TRS=3218 MPa, and the fracture toughness is 18.69 MPa*M$^{1/2}$. The content of plate-shape WC in the cemented carbide was 71.7%. The X-ray diffraction spectra of the T3G2 sample along directions of different sections are shown in FIGS. 18-19. The degree of oriented alignment of the plate-shape WC in the cemented carbide is shown in Table 3. The mechanical properties of the material are shown in Table 4.

Example 7

The steps of this example are basically the same as those of Example 6, except that the mass ratio of the raw W with a particle size of 0.3 μm and the raw W with a particle size of 5 μm are 2:3; the additional carbon content is 7.0% of the theoretical carbon content in the cemented carbide; and the WC-6Co cemented carbide with plate-shape WC grains prepared by the low-pressure sintering process is denoted as sample T2G3. The I(0001)/I(10 $\bar{1}$ 0) ratio of the cross-section and the longitudinal section are 1.37 and 0.32, respectively. Along the cross sectional direction, the hardness is about 92.6 HRA, TRS=3547 MPa, and the fracture toughness is 19.95 MPa*M$^{1/2}$; along the longitudinal sectional direction, the hardness is 92.3 HRA, TRS=3562 MPa, and the fracture toughness is 19.57 MPa*M$^{1/2}$. The content of plate-shape WC in the cemented carbide was 75%.

Figure 20:
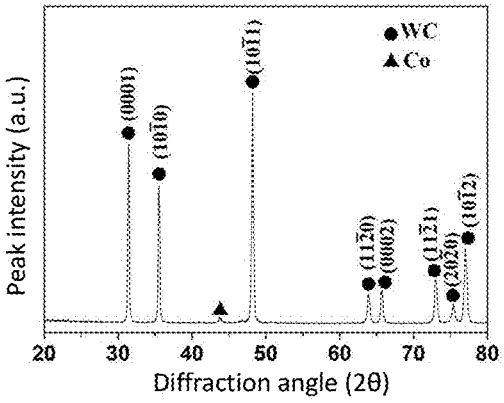
FIG. 20 is an X-ray diffraction pattern of a sample T2G3 which is a cemented carbide block in Example 7 along the cross sectional direction.
Figure 21:
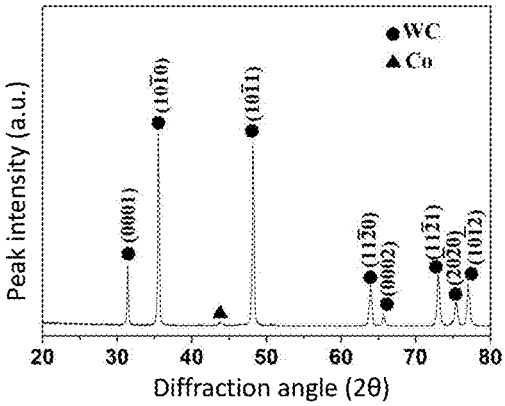
FIG. 21 is an X-ray diffraction diagram of a sample T2G3 which is a cemented carbide block in Example 7 along the longitudinal sectional direction.

The X-ray diffraction spectra of the T2G3 sample along directions of different sections are shown in FIGS. 20-21. The degree of oriented alignment of the T2G3 sample is shown in Table 3. The mechanical properties of the material are shown in Table 4.

Example 8

The steps of this example are basically the same as those of Example 6, except that the mass ratio of the raw W with a particle size of 0.3 μm and the raw W with a particle size of 5 μm are 1:4; the additional carbon content is 6.0% of the theoretical carbon content in the cemented carbide; and the WC-6Co cemented carbide with plate-shape WC grains prepared by the low-pressure sintering process is denoted as sample T1G4. The I(0001)/I(10$\bar{1}$0) ratio of the cross-section and the longitudinal section are 1.78 and 0.31, respectively. Along the cross sectional direction, the hardness is about 92.7 HRA, TRS=3378 MPa, and the fracture toughness is 19.04 MPa*$M^{1/2}$; along the longitudinal sectional direction, the hardness is 92.0 HRA, TRS=3018 MPa, and the fracture toughness is 18.23 MPa*$M^{1/2}$. The content of plate-shape WC in the cemented carbide was 78.3%.

Figure 22:
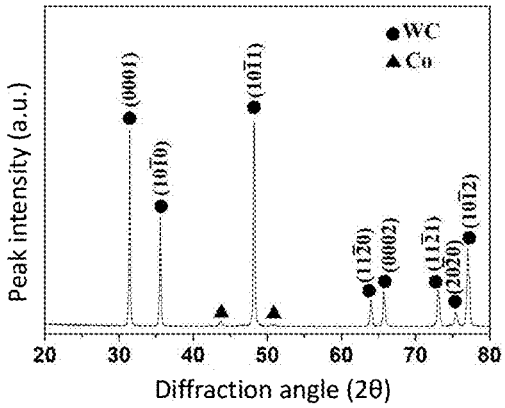
FIG. 22 is an X-ray diffraction pattern of a sample T1G4 which is a cemented carbide block in Example 8 along the cross sectional direction.
Figure 23:
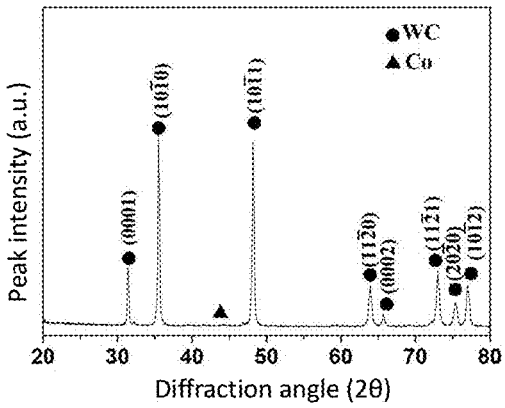
FIG. 23 is an X-ray diffraction pattern of the sample T1G4 which is a cemented carbide block in Example 8 along the longitudinal sectional direction.

The X-ray diffraction spectra of the T1G4 sample along directions of different sections are shown in FIGS. 22-23. The degree of oriented alignment of the T1G4 sample is shown in Table 3. The mechanical properties of the material are shown in Table 4.

TABLE 3

Degree of oriented alignment of plate-shape WC in WC-6Co cemented carbide containing plate-shape WC grains

| Sample | Cross section Ratio of peak intensity I(0001)/I(10$\bar{1}$0) | Longitudinal section Ratio of peak intensity I(0001)/I(10$\bar{1}$0) |
|---|---|---|
| T3G2 sample in Example 6 | 1.04 | 0.37 |
| T2G3 sample in Example 7 | 1.37 | 0.32 |
| T1G4 sample in Example 8 | 1.78 | 0.31 |

TABLE 4

Physical and mechanical properties of WC-6Co cemented carbide with plate-shape WC grains

| Sample | Stacking ratio | Cross section hardness/ HRA | Cross section TRS/ MPa | Cross section Fractural strength MPa*$m^{1/2}$ | Longitudinal section hardness/ HRA | Longitudinal section TRS/ MPa | Longitudinal section Fractural strength MPa*$m^{1/2}$ |
|---|---|---|---|---|---|---|---|
| T3G2 sample in Example 6 | 99.7% | 92.4. | 3282 | 18.32 | 92.3 | 3218 | 18.69 |
| T2G3 sample in Example 7 | 99.6% | 92.6 | 3547 | 19.95 | 92.3 | 3562 | 19.57 |
| T1G4 sample in Example 8 | 99.6% | 92.7 | 3378 | 19.04 | 92.2 | 3018 | 18.23 |

Example 9

(1) Taking WC-20 wt. % Co as a final component, selecting raw W having a particle size of 1.0 μm and raw W having a particle size of 25 μm as sources of W powder. According to the theoretical composition of the cemented carbide, the composition of the W powder consists of W having a particle size of 1.0 μm and W having a particle size of 25 μm in a mass ratio of 4:1. Weighting graphite powder with a size of 80 μm, Co powder with a size of 1.5 μm, and additional carbon which is 8.0% of the theoretical carbon content in the cemented carbide.

(2) Placing the above W powder, graphite powder and Co powder in a planetary ball mill to conduct low-energy pre-ball milling for 10 h, wherein the speed of the ball milling is 120 r/min, and the ball-to-batch ratio is 1:3 to achieve homogeneous distribution of the powder and low strength combination among the particles to obtain a pre-milled WC—Co powder.

(3) Placing the pre-ball-milled WC—Co powder in a plasma-assisted ball mill to conduct plasma-assisted ball milling for 6 h with a ball-to-batch ratio of 30:1, a ball-milling speed of 1200 r/min, and a discharge current of 2.0 A. W—C—Co composite powder containing small-sized lamellar W sheet and large-sized lamellar W sheet was obtained, wherein the small-sized lamellar W sheet has a length of 0.4-1.2 μm and a thickness of 100-200 nm, and the large-sized lamellar W sheet has a length of 0.3-11.0 μm and a thickness of 100-250 nm.

(4) Placing the W—C—Co composite powder containing lamellar W sheets with two sizes obtained in step (3) in a mold, pressing by uni-axial compression molding with a pressing pressure of 150 MPa and a pressing time of 4 min, then demolding to obtain a powder green body.

(5) Sintering the green body by a low pressure sintering process. The low-pressure sintering process is as follows: after vacuuming to 1 Pa, raising the temperature to 1500° C. at a heating rate of 10 K/min; after reaching the highest temperature, charging Ar gas at 4.5 MPa, keeping the temperature for 30 min, and then cooling to room temperature at a cooling rate of 20 Orlin to obtain WC-20Co cemented carbide having plate-shape WC grains, which was designated as sample X4Y1. The I(0001)/I(10 $\bar{1}$ 0) ratio of the cross-section and the longitudinal section are 0.96 and 0.33, respectively. Along the cross sectional direction, the hardness is about 89.1 HRA, TRS=4276 MPa, and the fracture toughness is 21.78 MPa*$M^{1/2}$; along the longitudinal sectional direction, the hardness is 89.2 HRA, TRS=4023 MPa, and the fracture toughness is 21.43 MPa*$M^{1/2}$. The content of plate-shape WC in the cemented carbide was 75.5%. The degree of oriented alignment of the plate-shape WC in the X4Y1 sample is shown in Table 5. The mechanical properties of the material are shown in Table 6.

Example 10

The steps of this example are basically the same as those of Example 9, except that the mass ratio of the raw W with a particle size of 1.0 μm and the raw W with a particle size of 25 μm are 1:1; the additional carbon content is 4.3% of the theoretical carbon content in the cemented carbide; and the WC-20Co cemented carbide with plate-shape WC grains prepared by the low-pressure sintering process is denoted as sample X1Y1. The I(0001)/I(10 $\bar{1}$ 0) ratio of the cross-section and the longitudinal section are 1.82 and 0.27, respectively. Along the cross sectional direction, the hardness is about 89.4 HRA, TRS=4682 MPa, and the fracture toughness is 22.14 MPa*$M^{1/2}$; along the longitudinal sectional direction, the hardness is 89.2 HRA, TRS=4445 MPa, and the fracture toughness is 21.97 MPa*$M^{1/2}$. The content of plate-shape WC in the cemented carbide was 78.9%.

The degree of oriented alignment of the plate-shape WC in the X1Y1 sample is shown in Table 5. The mechanical properties of the material are shown in Table 6.

Example 11

The steps of this example are basically the same as those of Example 9, except that the mass ratio of the raw W with a particle size of 1.0 μm and the raw W with a particle size of 25 μm are 1:4; the additional carbon content is 2.9% of the theoretical carbon content in the cemented carbide; and the WC-20Co cemented carbide with plate-shape WC grains prepared by the low-pressure sintering process is denoted as sample X1Y4. The I(0001)/I(10 $\bar{1}$ 0) ratio of the cross-section and the longitudinal section are 2.84 and 0.21, respectively. Along the cross sectional direction, the hardness is about 89.5 HRA, TRS=4398 MPa, and the fracture toughness is 22.85 MPa*$M^{1/2}$; along the longitudinal sectional direction, the hardness is 89.1 HRA, TRS=3814 MPa, and the fracture toughness is 21.45 MPa*$M^{1/2}$. The content of plate-shape WC in the cemented carbide was 82.4%.

The degree of oriented alignment of the plate-shape WC in the X1Y4 sample is shown in Table 5. The mechanical properties of the material are shown in Table 6.

TABLE 5

Degree of oriented alignment of plate-shape WC in WC-20Co cemented carbide containing plate-shape WC grains

| Sample | Cross section Ratio of peak intensity I(0001)/I(10$\bar{1}$0) | Longitudinal section Ratio of peak intensity I(0001)/I(10$\bar{1}$0) |
|---|---|---|
| X4Y1 sample in Example 9 | 0.96 | 0.33 |
| X1Y1 sample in Example 10 | 1.82 | 0.27 |
| X1Y4 sample in Example 11 | 2.84 | 0.21 |

TABLE 4

Physical and mechanical properties of WC-20Co cemented carbide with plate-shape WC grains

| Sample | Stacking ratio | Cross section hardness/HRA | Cross section TRS/MPa | Cross section Fractural strength MPa*$m^{1/2}$ | Longitudinal section hardness/HRA | Longitudinal section TRS/MPa | Longitudinal section Fractural strength MPa*$m^{1/2}$ |
|---|---|---|---|---|---|---|---|
| X4Y1 sample in Example 9 | 99.6% | 89.1 | 4276 | 21.78 | 89.2 | 4023 | 21.43 |
| X1Y1 sample in Example 10 | 99.5% | 89.4 | 4682 | 22.14 | 89.2 | 4445 | 21.97 |
| X1Y4 sample in Example 11 | 99.8% | 89.5 | 4398 | 21.85 | 89.1 | 3814 | 21.45 |

The above embodiments are preferred embodiments of the present invention, but the embodiments of the present invention are not limited to the embodiments. Any other changes, modifications, substitutions, combinations and simplifications may be made without departing from the spirit and scope of the invention, all of which are equivalent replacement means, and are included in the scope of protection of the present invention.

The invention claimed is:

1. A preparation method of a WC cemented carbide with adjustable alignment of plate-shaped grains, comprising the steps of:

(1) weighting graphite powder, Co powder and W powder according to the composition of WC-XCo; characterized in that, the W powder comprises fine W particles and coarse W particles, and 6≤X≤20;

the fine W particles have a particle size of 0.3 μm-1 μm;

the coarse W particles have a particle size of 5 μm-25 μm;

the mass ratio of the fine W particles to the coarse W particles is 1:4-4:1;

(2) adding the graphite powder, the Co powder and the W powder in step (1), and required extra amount of carbon in a planetary ball mill for planetary ball milling to obtain W—C—Co powder;

(3) placing the W—C—Co powder obtained in step (2) in a plasma-assisted high-energy ball mill for plasma-assisted ball milling to obtain W—C—Co composite powder;

(4) subjecting the W—C—Co composite powder obtained in step (3) to uniaxial compression molding to obtain W—C—Co powder greed body;

(5) carbonizing the W—C—Co powder green body by sintering at 1350-1550° C.

2. The preparation method of a WC cemented carbide with adjustable alignment of plate-shape grains, according to claim 1, characterized in that, the graphite powder in step (1) has a particle size of 20 μm-80 μm.

3. The preparation method of a WC cemented carbide with adjustable alignment of plate-shape grains, according to claim 1, characterized in that, the particle size of the Co powder in step (1) is 0.5 μm-5 μm.

4. The preparation method of a WC cemented carbide with adjustable alignment of plate-shape grains, according to claim 1, characterized in that the specific parameters of the planetary ball milling in step (2) are: a ball-to-batch ratio of 1:3-1:5, and a ball milling time of 5-10 h.

5. The preparation method of a WC cemented carbide with adjustable alignment of plate-shape grains according to claim 1, characterized in that, the specific parameters of the plasma-assisted ball milling in step (3) are: a ball-to-batch ratio of 30:1-60:1, a ball milling time of 3-6 h, and a discharge current of 1-3 A.

6. The preparation method of a WC cemented carbide with adjustable alignment of plate-shape grains according to claim 1, characterized in that, the WC—Co composite powder in step (3) is composed of a small-sized lamellar W sheet and a large-sized W sheet, wherein the small-sized lamellar W sheet has a length of 200 nm-1.5 μm and a thickness of 40 nm-200 nm, and the large-sized lamellar W sheet has a length of 3 μm-15 μm and a thickness of 60 nm-300 nm.

7. The preparation method of a WC cemented carbide with adjustable alignment of plate-shape grains according to claim 1, characterized in that, said carbonizing by sintering refers to vacuum sintering or low pressure sintering.

* * * * *